US005309679A

United States Patent [19]

Ward

[11] Patent Number: 5,309,679

[45] Date of Patent: May 10, 1994

[54] REGULATING MECHANISM FOR MOTOR VEHICLE WINDOW

[75] Inventor: Marcus J. S. Ward, Billericay, United Kingdom

[73] Assignee: Ford Motor Company, Dearborn, Mich.

[21] Appl. No.: 80,990

[22] Filed: Jun. 22, 1993

Related U.S. Application Data

[63] Continuation of Ser. No. 773,862, Oct. 15, 1991, abandoned.

[30] Foreign Application Priority Data

Apr. 15, 1989 [GB] United Kingdom ..... 8908603

[51] Int. Cl.[5] ..... E05F 11/48

[52] U.S. Cl. ..... 49/352

[58] Field of Search ..... 49/348, 349, 352, 139, 49/360

[56] References Cited

U.S. PATENT DOCUMENTS

| | | | |
|---|---|---|---|
| 2,432,799 | 12/1947 | Rappl | 49/349 |
| 3,394,497 | 7/1968 | Case | 49/360 |
| 4,110,935 | 9/1978 | Sessa | 49/352 |
| 4,920,697 | 5/1990 | Vail et al. | 49/348 |
| 4,937,977 | 7/1990 | Gergoe et al. | 49/360 X |
| 4,970,827 | 11/1990 | Djordjevic | 49/352 X |
| 5,001,867 | 3/1991 | DuPuy | 49/352 X |

FOREIGN PATENT DOCUMENTS

| | | | |
|---|---|---|---|
| 631130 | 10/1949 | United Kingdom | 49/352 |
| 2230558 | 10/1990 | United Kingdom | 49/352 |

*Primary Examiner*—Peter M. Cuomo
*Assistant Examiner*—Jerey Redman
*Attorney, Agent, or Firm*—Daniel M. Stock; Roger L. May

[57] ABSTRACT

A regulating mechanism is described for a motor vehicle window located between longitudinally spaced guides in a vehicle door. The mechanism comprises a cranking handle and Bowden cable for connection to one side of the window for raising and lowering the window 10 within the window guides, and another Bowden cable *22a,22b* connected in use only to the window 10 and to the vehicle door 12 and serving to move the other side of the window 10 in synchronism with and in response to movement of the first side.

1 Claim, 5 Drawing Sheets

10
20a
20b
16a
16b
22a
22
22b
12
18a
18b
14
22b
16
13
16c
16a
11
24a
24b 10
116a
20a
20b
12
18a
22
18b
22b
116c
13
116b
11
116
22b
14
24a
24b

REGULATING MECHANISM FOR MOTOR VEHICLE WINDOW

This application is a continuation of application Ser. No. 07/773,862, filed Oct. 15, 1991, entitled: REGULATING MECHANISM FOR MOTOR VEHICLE WINDOW, now abandoned.

TECHNICAL FIELD

The invention relates to a regulating mechanism for a motor vehicle window, that is to say a mechanism for raising and lowering a window in its guides.

BACKGROUND ART

Various regulating mechanisms have been used in the past to raise and lower a window in a vehicle. One known mechanism employs rigid plates hinged in a form of scissor arm configuration to raise and lower the window as a cranking handle is turned. The disadvantage of such a mechanism is that it presents difficulty in assembly and hinders access to other items such as the door handle and the lock.

It is also known to use a Bowden cable to raise and lower a window. The inner cable of a Bowden cable passes around a drum which is turned by a cranking handle or an electric motor and is connected to an anchoring point on the window. As the drum is turned, the end of the cable raises or lowers the window.

Cable operated regulating mechanisms can be single lift or double lift. In the former case, the window is raised from a single point and steps must be taken to ensure that the window does not tilt in its guides while it is being moved as this might lead to jamming.

In double lift mechanisms, either two separately driven cables may be employed or a single driven cable may be wound in a figure eight around guides or pulleys and attached at two points to the window.

DISCLOSURE OF THE INVENTION

According to the present invention, there is provided a regulating mechanism for a motor vehicle window located between longitudinally spaced guides in a vehicle door, which mechanism comprises means for connection to a first side of the window for raising and lowering the window within the window guides, characterized in that a Bowden cable, which in use is connected only to the window and to the vehicle door, is provided to exert a force on the other side of the window to prevent the window from tilting relative to the guides.

In a first embodiment of the invention, when in use, the outer sheath of the Bowden cable is mounted for movement with the window and the ends of the inner cable are anchored, in use, to fixed points on the vehicle door.

In an alternative embodiment, when in use, the outer sheath of the Bowden cable is fixed relative to the vehicle door and the ends of the inner cable are connected to the window.

The means for raising and lowering the window may comprise a manually or electrically driven drum and a second Bowden cable acting between the vehicle door and the window to move the window in response to the rotation of drum.

There are various possibilities for the connections of the second Bowden cable but in the preferred embodiment, the outer sheath of the second Bowden cable is fixed to the window frame and the inner cable has a central portion wound about the drum and its two ends connected to the window and to the vehicle door respectively.

BRIEF DESCRIPTION OF THE DRAWINGS

The invention will now be described further, by way of example, with reference to the accompanying drawings, in which.

BEST MODE FOR CARRYING OUT THE INVENTION

Figure 1:
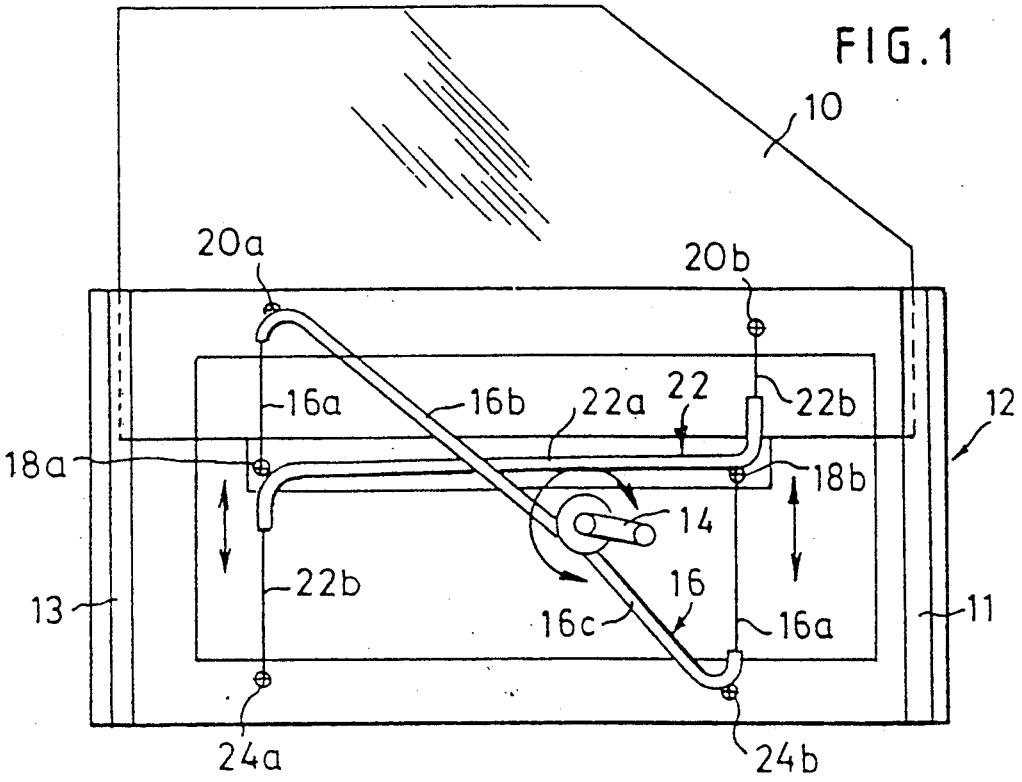
FIG. 1 is a schematic representation of a first embodiment of the invention.

FIG. 1 shows a window 10 mounted for vertical movement in a door frame 12, the window 10 being disposed in a conventional manner between guides 11 and 13. The guides 11 and 13 are arranged to define generally vertically extending paths at the front and rear sides of the window 10, respectively, and may form a frame around the window when raised or they may be disposed entirely within the door panel in the case of a frameless window.

A cranking handle 14, mounted on the door in a manner not shown, forms part of the means for raising and lowering the window 10. The handle 14 is connected to a drum about which there are wound several turns of the inner core 16*a* of a Bowden cable 16. The ends of the inner core 16*a* of the Bowden cable 16 are secured to respective anchoring points 18*a* and 18*b* on the window.

The outer sheath of the Bowden cable 16 has two parts 16*b* and 16*c* of which the part 16*b* is anchored at 20*a* to an upper member of the door and the part 16*c* is anchored at 24*b* to a lower member of the door.

The parts of the regulating mechanism so far described, permit the window 10 to be raised and lowered by acting on anchoring points 18*a* and 18*b* offset from the center of gravity of the window 10. In particular, if cranked clockwise, the handle 14 will shorten the length of the inner core 16*a* between the point 18*b* and 24*b* and thereby pull the window down. At the same time the run of the inner core 16*a* between the points 20*a* and 18*a* is lengthened so that the window can fall at this end under its own weight. In practice, the run of the inner core 16*a* between the points 20*a* and 18*a* is in tension when the window is fully raised and the window starts to fall under its own weight before being pulled down by the shortening of the run between the points 18*b* and 24*b*.

Counter-clockwise rotation of the handle will conversely raise the window 10 relative to the door 12 by shortening the run between the points 18*a* and 20*a* while lengthening the run between the points 18*b* and 24*b*.

Gravity acts on the window 10 through its center of gravity but the lifting force on the window which opposes gravity is always applied at the point 18*a* which is offset from the center of gravity. Consequently, there is a torque acting on the window tending to make it jam within its guides 11 and 13.

To counteract this tendency to jam, a Bowden cable 22 is provided which is not connected to the handle 14 nor to its drum but only to the window 10 and to the door 12. The outer sheath 22a of the Bowden cable 22 is anchored near the lifting points 18a and 18b on the window whereas the ends of the inner core 22b of the cable are anchored to fixed points 20b on the upper door member and 24a on the lower door member. As far as possible, the points 20a, 18a and 24a on the left side and the points 20b, 18b and 24b on the right side should lie on lines parallel to the window guides.

As the window is lowered, the run of the inner core 22b between the points 18a and 24a will now be reduced and the length of the run between the points 18b and 20b increased. The tension in the latter run will therefore be slowly released to allow the window to drop in synchronism with the right hand side, as viewed.

Conversely, when the window is raised, the run between the points 18a and 24a will be increased in length and the run between the point 18b and 20b reduced in length to raise the right hand side of the window 10, as viewed, in response to raising of its left hand side.

The connections of the inner core and the outer sheath of the Bowden cables can be interchanged and this will be clearer from the remaining embodiments illustrated in the drawings.

Figure 2:
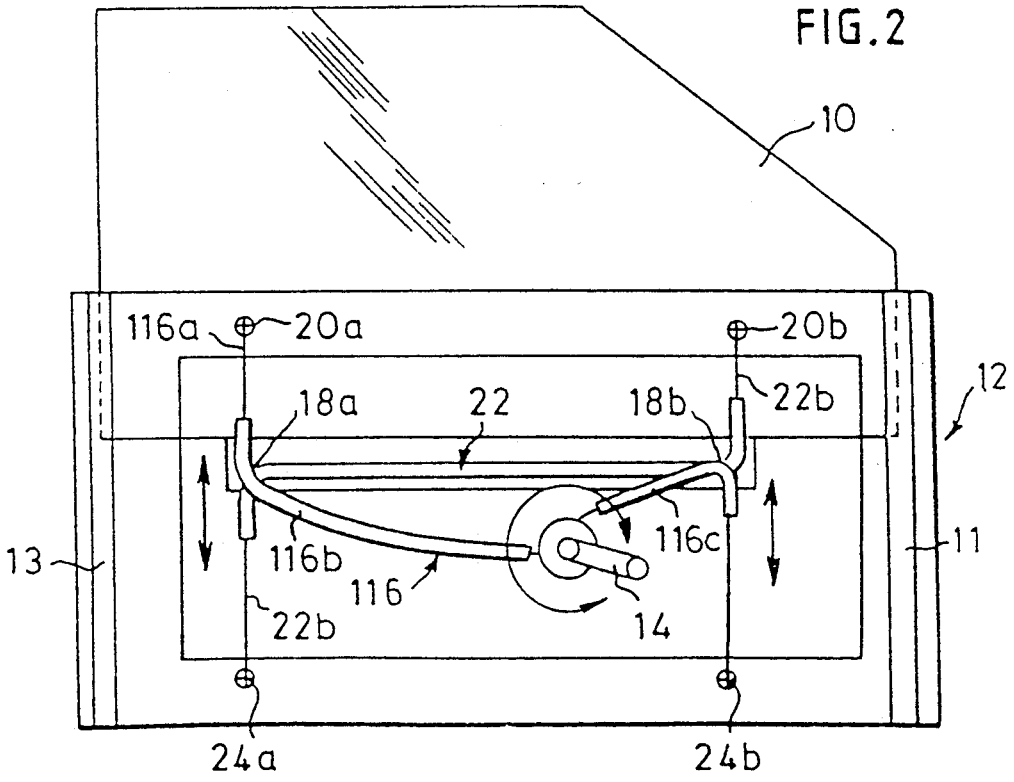
FIGS. 2 to 4 are similar representations of alternative embodiments of the invention.

The embodiment of FIG. 2 differs from that of FIG. 1 in that, as compared with the cable 16 in FIG. 1, the connections of the first Bowden cable 116 have been reversed. The two parts 116b, 116c of the outer sheath of the cable 116 are now anchored to the window 10 at the points 18a and 18b, respectively, and it is the ends of the inner core 116a of the cable 116 that are attached to the points 24b and 20a on the door members. There is no essential difference in the operation of this embodiment from that previously described and, in particular, the construction and operation of the cable 22 has not been changed.

Figure 3:
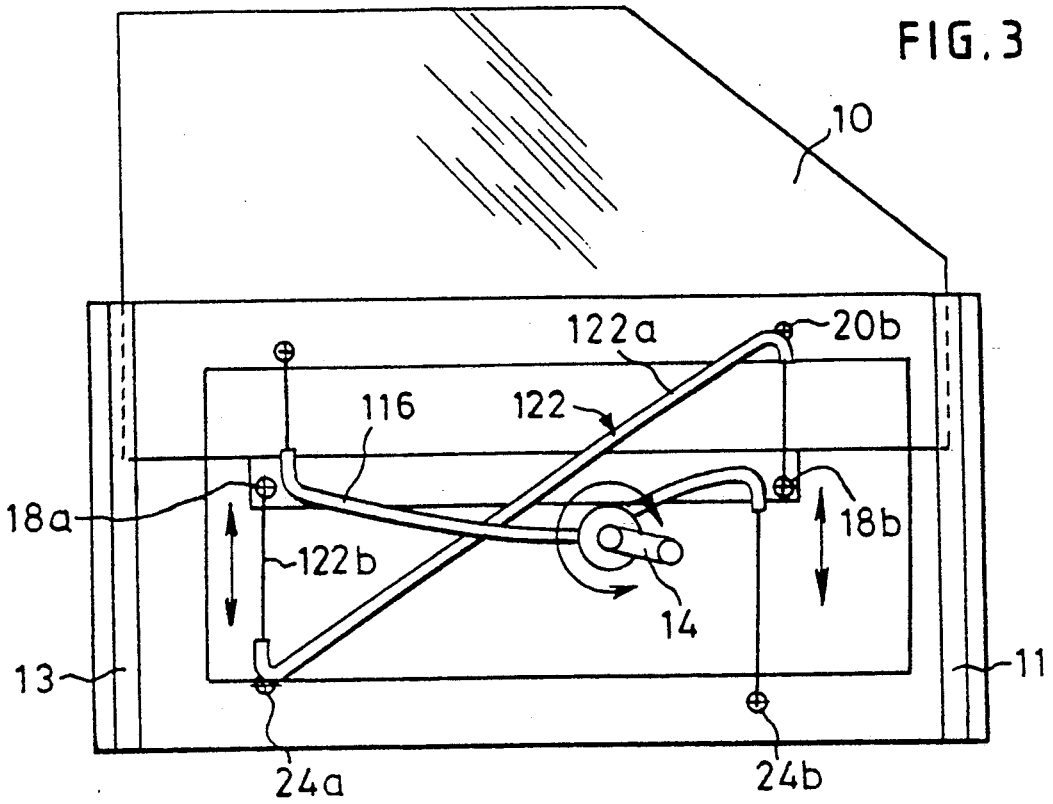

The embodiment of FIG. 3 differs from that of FIG. 2 in that, as compared with the cable 22 in FIGS. 1 and 2, the connections of the second Bowden cable 122 have been reversed. The ends of the outer sheath 122a of the cable 122 are anchored to the upper and lower members, at the points 20b and 24a, respectively, and it is the ends of the inner core 122b of the cable 122 that are attached to the points 18a and 18b on the window 10. There is again no essential difference in the operation of this embodiment from those previously described.

Figure 4:
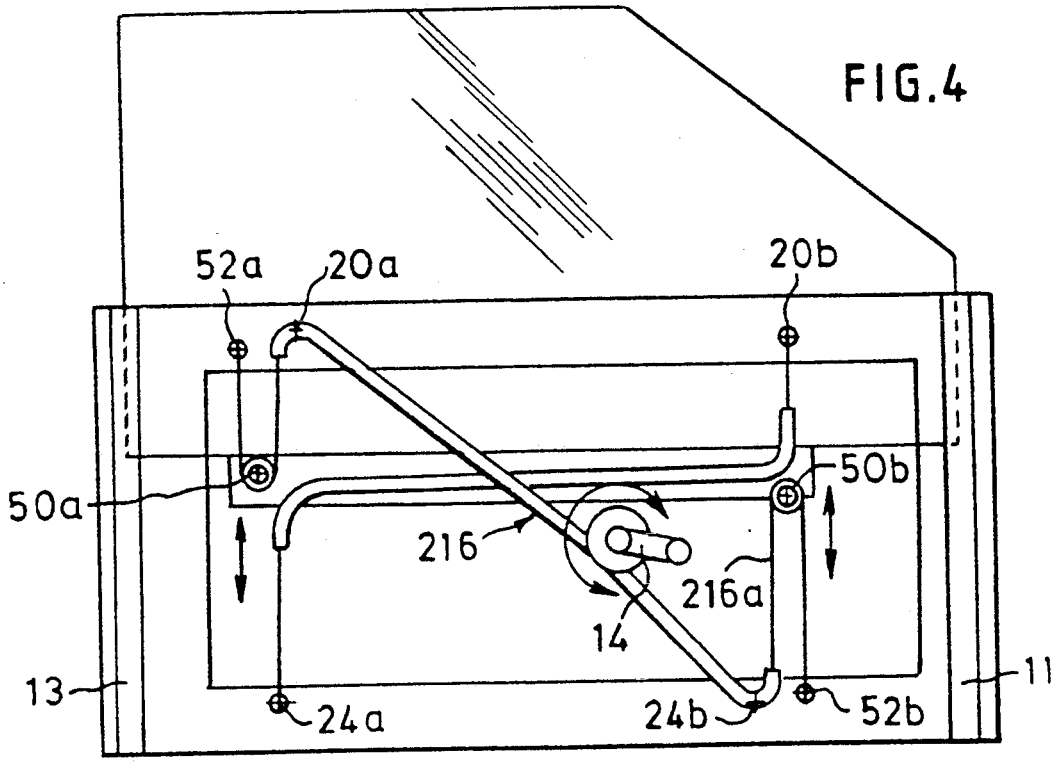

The embodiment of FIG. 4 illustrates that a pulley system can be used in conjunction with the Bowden cable to alter the mechanical advantage of the regulating mechanism. As compared with the embodiment of FIG. 1, instead of the ends of the inner core 16a of the Bowden cable 16 being attached directly to the lifting points 18a and 18b on the window 10, the inner core 216a of the cable 216 passes around pulleys 50a and 50b at the lifting points 18a and 18b and is then anchored to stationary fixing points 52a and 52b adjacent the points 20a and 24b, respectively. In this case, the rate of movement of the window 10 is one half of the rate of movement of the inner core 216a of the Bowden cable 216.

In the embodiments described above, the window 10 moves in straight guides 11 and 13 and its opposite sides move at the same rate so that the window does not tilt as it moves up and down in its guides. It is however possible for the window guides not to be straight and embodiments in which the window does not move linearly will now be described by reference to FIGS. 5 to 8.

Figure 5:
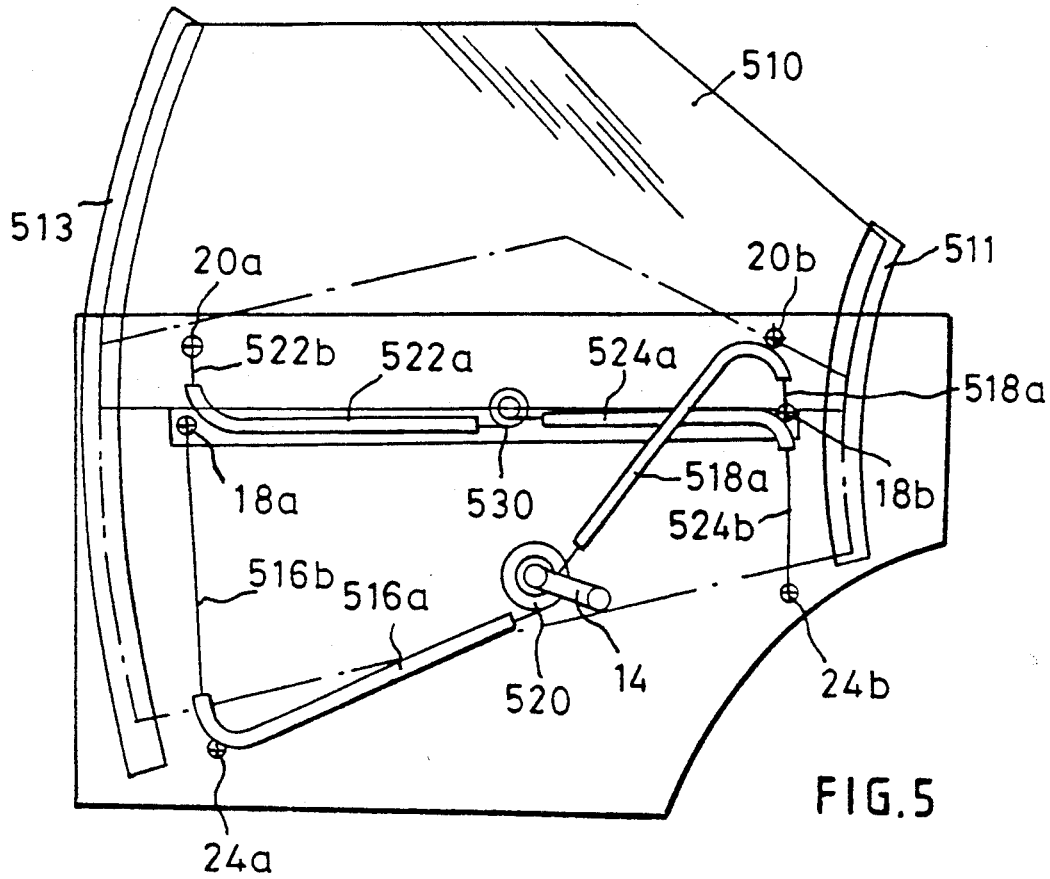
FIGS. 5 and 6 are similar representations of two further embodiments of the invention in which the window is guided to follow an arcuate path and tilts as it is raised and lowered.
Figure 6:
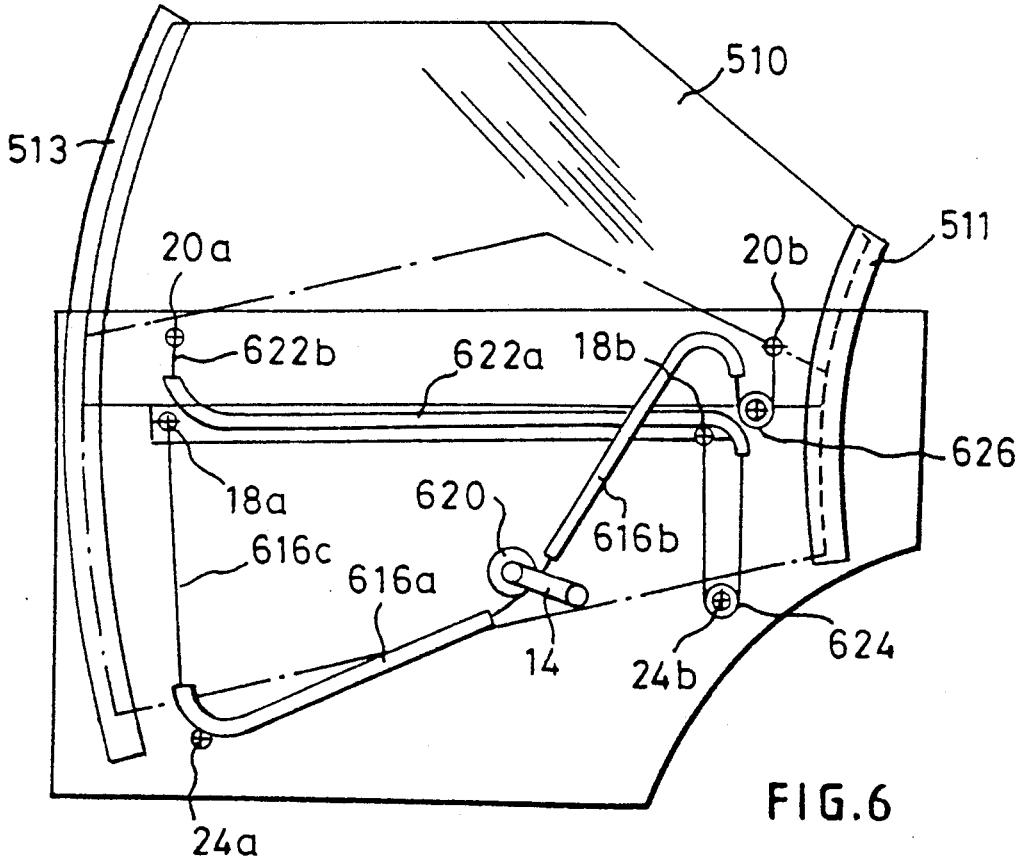

In the embodiments of FIGS. 5 and 6, the window 510 is located between arcuate guides 511 and 513, centered on the same point, and is intended to tilt as it moves down, as may be seen from the lowered position of the window 510 shown in dotted lines. Such a configuration may for example be required to enable a driver to lean his arm on the edge of the window opening in the case of a vehicle in which, because of the proximity of a wheel arch, the shape of the door limits the extent to which the window 510 can be lowered at one end.

In FIG. 5, the front and rear sides of the window 510 are required to move at different rates from one another and this is achieve by including reduction mechanisms in the cables. The handle 14 is connected to a drum 520 having two portions of different diameter. One end of the inner core 516b of a Bowden cable having an outer sheath 516a is wound around the larger diameter portion of the drum 520 and its other end is anchored at the point 18a. The outer sheath 516a is anchored at the point 24a on the lower door frame member. Similarly, one end of the inner core 518b of a Bowden cable having an outer sheath 518a is wound around the smaller diameter portion of the drum 520 and its other end is anchored at the point 18b. The outer sheath 518a is anchored at the point 20b on the upper door frame member.

A freely rotatable drum 530 is mounted on the window 510 and also has two portion of different diameter. One end of the inner core 522b of a Bowden cable having an outer sheath 522a is wound around the larger diameter portion of the drum 530 and its other end is anchored at the point 20a. The outer sheath 522a is anchored at the point 18a on the window. Lastly, one end of the inner core 524b of a Bowden cable having an outer sheath 524a is wound around the smaller diameter portion of the drum 530 and its other end is anchored at the point 24b on the lower door frame member. The outer sheath 524a is anchored at the point 18b on the window.

Apart from the presence of the drums 520 and 530 with portions of different diameter, the lifting mechanism in this embodiment is the same as that shown in FIG. 1. The drums 520 and 530 act as a reduction mechanism to ensure that the amount of movement at the two sides of the window 510 are not equal but in the ratio of the diameters of the smaller and larger portions of the drums 520 and 530.

In the embodiment of FIG. 6 a simpler configuration is achieved by using pulleys as a reduction mechanism instead of the drums with portions of different diameter. This configuration, however, can only be used when one side of the window moves twice the distance of the other.

The central portion of the inner core 616c of a cable having two outer sheaths 616a and 616b is wound around a drum 620 rotatable by the handle 14. The outer sheath 616a is anchored at the point 24a and the outer sheath 616b is anchored near the point 20b on the upper door frame member. One end of the inner core is connected to the point 18a on the window while its other end first passes around a pulley 626 mounted on the window 510 and is then anchored at the point 20b.

The inner core 622b of a second cable is anchored at one end a the point 20a and its other end passes around a pulley 624 arranged that the point 24b before being connected to the point 18*b* on the window 510. The outer sheath 622*a* of this cable is anchored near the points 18*a* and 18*b* on the window.

Because of the reduction achieved by the pulleys 624 and 626, right hand side of the window, as viewed, moves at half the rate of the left hand side thus enabling the window to follow the arcuate guides 511 and 513.

Figure 7:
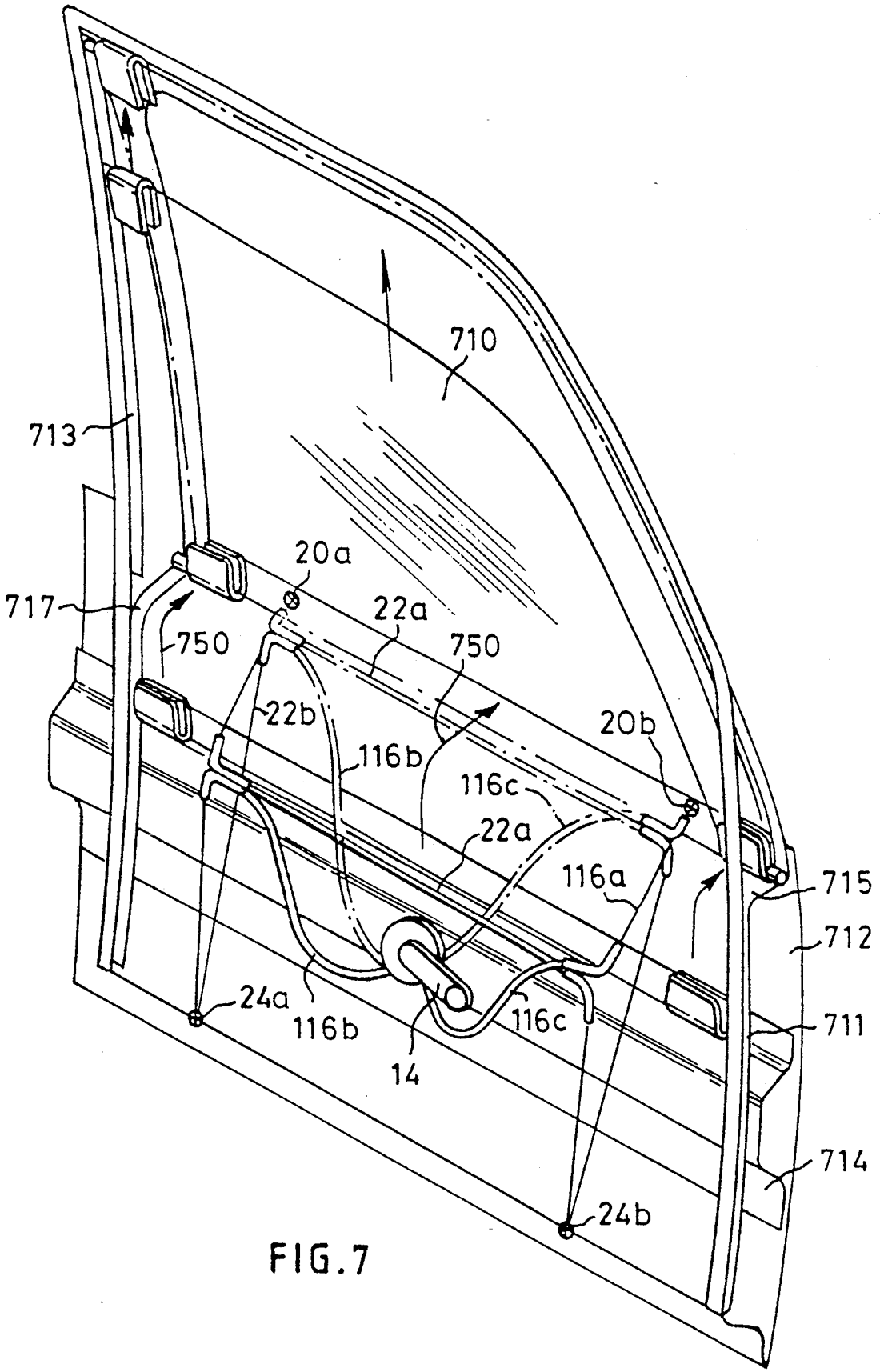
FIG. 7 is perspective view of a door with offset guides to allow the window glass to fit flush with the door panel in the closed position.

The cable lifting mechanism used in the embodiment of FIGS. 7 and 8 can be the same as any those described by reference to FIGS. 1 to 4 and will not therefore be described in detail. To avoid repetition of description the same configuration as used in FIG. 2 has been adopted and the same reference numerals have been used to designate components serving the same or an analogous function. The cables are shown in both the raised and the lowered position of the window and the path followed by the lower edge of the window is indicated by arrows 750.

Figure 8:
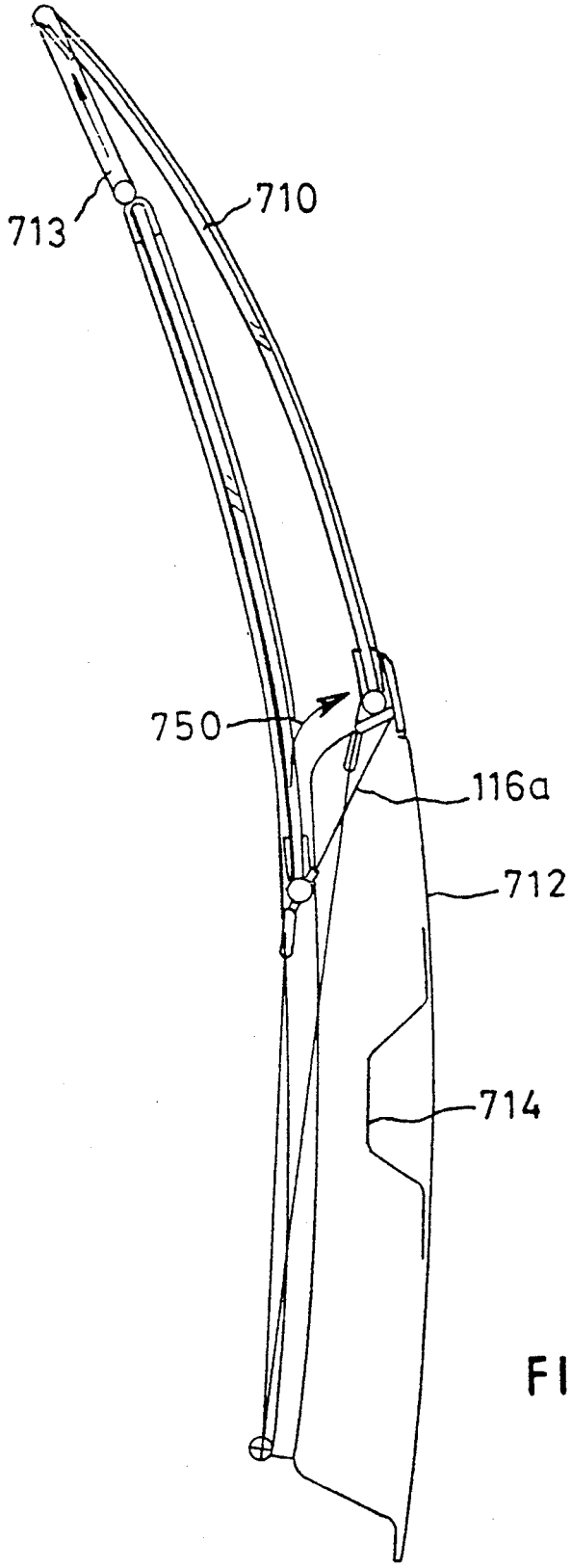
FIG. 8 is an end view of the door in FIG. 7.

As best seen from FIG. 8, the window 710 is meant in its closed position to lie as near flush as possible with the door panel 712. However, if the window were to be wound down from this position it would collide with other items mounted in the door, for example the reinforcement bar 714. The window is therefore guided instead in guides 711 and 713 which include branching points 715 and 717 which cause the lower edge of the window to move at right angles with the plane of the window towards the end of its upward travel. It should be noticed how the inclination of the inner cores 22*b* and 116*a* changes as the window is raised and the effect of this change of inclination is to pull the lower edge of the glass into the flush position so as to divert it at the branching points 715 and 717.

In all the embodiments of the invention, the window is raised and lowered by means of a single lift mechanism and the raising of the other side is effect by coupling the sides of the window to one another using a Bowden cable to provide a double lift mechanism without the complication of using two cables each wound on a separate driven drum and acting on a different side of the window. Apart from the issue of expense, it is difficult to fit two such driven drums within the thickness of a door where space is at a premium.

An advantage of the invention is that it reduces the complexity of the regulating mechanism and allows it to be installed more simply. The invention also lends itself well to the regulation of windows which do not move vertically in the door but along a slightly inclined axis, in order for example to reduce friction with the window frame. This is because the alignment of the various lifting and reaction points 18, 20 and 24 can be selected almost at will to provide the desired line of force generally parallel to the guides, regardless of the inclination of these guides.

A further feature of the invention is that the means provided for raising the first side of the window are independent of the Bowden cable used to apply a force to the other side of the window and they can therefore be installed or serviced separately.

It should also be appreciated that a motor driven drum can be substituted for the manual crank so that the invention is equally applicable to electrically operated windows.

I claim:

1. A regulating system for a window having generally vertical front and rear sides and positioned in a vehicle door for movement generally vertical with respect to a pair of longitudinally spaced window guides receiving the front and rear sides of the window; the regulating system comprising:

crank means reversibly rotatably mounted on the vehicle door and having a cable having a first end fixedly secured to the front side of the window and a second end fixedly secured to the rear side of the window, rotation of the crank means being operative to selectively pull the front or the rear of the window upon corresponding rotation of the crank means and;

a single Bowden cable having an outer sheath and an inner core slidably movable with respect to the sheath, the core having one end fixedly secured to an upper portion of the vehicle door longitudinally proximate the front side of the window and another end fixedly secured to a lower portion of the vehicle door longitudinally proximate the rear side of the window and the sheath is fixedly secured to the window;

whereby rotation of the crank is operative to selectively raise or lower the window through exertion of the tension from the cable on the front or the rear edge of the window and the Bowden cable is operative guide the generally vertical movement of the window.

* * * * *